US009589491B2

(12) United States Patent
Won

(10) Patent No.: US 9,589,491 B2
(45) Date of Patent: Mar. 7, 2017

(54) POWER SUPPLY DEVICE AND METHOD FOR DRIVING POWER SUPPLY DEVICE

(71) Applicant: Samsung Display Co., Ltd., Yongin, Gyeonggi-Do (KR)

(72) Inventor: Young Uk Won, Cheongju-si (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 101 days.

(21) Appl. No.: 14/579,611

(22) Filed: Dec. 22, 2014

(65) Prior Publication Data

US 2015/0339970 A1 Nov. 26, 2015

(30) Foreign Application Priority Data

May 20, 2014 (KR) ..... 10-2014-0060526

(51) Int. Cl.
*G09G 3/20* (2006.01)

(52) U.S. Cl.
CPC ..... *G09G 3/20* (2013.01); *G09G 2330/028* (2013.01)

(58) Field of Classification Search
None
See application file for complete search history.

(56) References Cited

U.S. PATENT DOCUMENTS 5,841,412 A * 11/1998 Ebihara ..... G09G 3/20 345/212
7,017,053 B2 * 3/2006 Mizuyabu ..... G06F 1/3203 345/212
9,052,902 B2 * 6/2015 Hayek ..... G06F 1/3218 345/520
2002/0075004 A1 * 6/2002 Yudahira ..... G01R 31/3658 324/434
2003/0025663 A1 * 2/2003 Waterman ..... G09G 3/2011 345/89
2004/0227775 A1 * 11/2004 Shimizu ..... G09G 3/3696 345/690
2005/0007392 A1 * 1/2005 Kasai ..... G09G 3/2014 345/690

(Continued)

FOREIGN PATENT DOCUMENTS

KR 10-2001-0106892 A 12/2001
KR 10-2006-0039802 A 5/2006

(Continued)

*Primary Examiner* — Antonio Xavier
(74) *Attorney, Agent, or Firm* — Ladas & Parry LLP

(57) ABSTRACT

A power supply device for a display device and method for driving the power supply device are disclosed. In one aspect the device includes a power voltage selector configured to select at least one of a plurality of predetermined voltage values according to a power voltage control signal and output the selected predetermined voltage value. The device also includes a power voltage supplier configured to supply a power voltage corresponding to the selected predetermined voltage value to a display data processor and a controller configured to generate the power voltage control signal based at least in part on a change in a number of switched data bits defined as a data change degree. The controller is also configured to transmit the power voltage control signal to the power voltage selector. The data bits are configured to be switched substantially synchronously with a clock signal.

20 Claims, 5 Drawing Sheets

(56) References Cited

U.S. PATENT DOCUMENTS

2005/0190142 A1* 9/2005 Ferguson ..... G09G 3/3406 345/102
2006/0007095 A1* 1/2006 Kudo ..... G06F 1/3203 345/98
2007/0164822 A1* 7/2007 Murthy ..... H03G 1/0088 330/278
2008/0111812 A1* 5/2008 Shirasaki ..... G09G 3/3233 345/212
2008/0150934 A1* 6/2008 Ozaki ..... G09G 3/22 345/214
2008/0186319 A1* 8/2008 Boner ..... G09G 5/393 345/545
2008/0238833 A1* 10/2008 Hioki ..... G09G 3/3233 345/76
2008/0303754 A1* 12/2008 Murata ..... G09G 3/3233 345/76
2010/0013867 A1* 1/2010 Kim ..... G09G 3/3233 345/690
2011/0181786 A1* 7/2011 Yamazaki ..... G09G 3/2077 348/671
2012/0263219 A1* 10/2012 Kim ..... H04B 13/005 375/224
2013/0120343 A1* 5/2013 Ahn ..... G09G 1/005 345/211
2013/0214831 A1* 8/2013 Park ..... G04F 10/005 327/156
2014/0055697 A1* 2/2014 Saitoh ..... G09G 3/3688 349/37
2015/0279474 A1* 10/2015 Shimura ..... G11C 11/5642 365/185.2

FOREIGN PATENT DOCUMENTS

KR 10-2009-0049157 A 5/2009
KR 10-2010-0049878 A 5/2010
KR 10-2012-0117782 A 10/2012

* cited by examiner

POWER SUPPLY DEVICE AND METHOD FOR DRIVING POWER SUPPLY DEVICE

INCORPORATION BY REFERENCE TO ANY PRIORITY APPLICATIONS

This application claims priority to and the benefit of Korean Patent Application No. 10-2014-0060526 filed in the Korean Intellectual Property Office on May 20, 2014, the entire contents of which are incorporated herein by reference.

BACKGROUND

Field

The described technology generally relates to a power supply device and a method for driving the power supply device.

Description of the Related Technology

In general, an integrated circuit (IC) includes a logic circuit performing a special function and a power supply circuit supplying power to the logic circuit. The power supply circuit must supply substantially stable power regardless of an impedance change of the circuit receiving the power and wiring. This particular type of power supply circuit is referred to as a voltage regulator, and the voltage regulator can be included in various kinds of ICs.

As recent ICs have increased in performance and become more highly integrated, the number of logic circuits included in the IC has also increased. When multiple discrete logic circuits are driven, overall current consumption of the IC also increases.

SUMMARY OF CERTAIN INVENTIVE ASPECTS

One inventive aspect is a power supply device for a flat panel display such as an organic light-emitting diode (OLED) display or a liquid crystal display (LCD).

Another aspect is a power supply device that includes: a power voltage selection unit outputting at least one among a plurality of predetermined voltage values according to a transmitted power voltage control signal; a power voltage supplier outputting a power voltage corresponding to the predetermined voltage value; and a controller outputting the power voltage control signal according to a change degree of data processed in synchronization with a clock signal.

A switching activity detection unit detecting a bit number of bits of data switched in synchronization with the clock signal when the data is processed by a unit of a plurality of bits in synchronization with the clock signal can be further included, and the controller can determine the data change degree by using the number of bits of switched data.

The controller can determine a section corresponding to the number of bits of switched data among the plurality of divided sections to determine the data change degree.

The controller can output a power voltage control signal increasing a voltage value output from the power voltage supplier if the data change degree is increased.

The power voltage selection unit can include: a register storing a plurality of predetermined voltage values; and a mux outputting at least one among a plurality of predetermined voltage values stored to the register according to the power voltage control signal.

A current detection unit detecting a current generated by processing the data by using the power voltage can be further included, and the controller can output the power voltage control signal by further considering the current value detected in the current detection unit.

If the current value detected in the current detection unit exceeds a predetermined current value, the controller can output a power voltage control signal increasing the voltage value output in the power voltage supplier.

Another aspect is a method for driving a power supply device that includes: determining a change degree of data processed in synchronization with a clock signal; outputting a power voltage control signal according to the data change degree; outputting at least one among a plurality of predetermined voltage values according to the power voltage control signal; and outputting a power voltage corresponding the predetermined voltage value.

The determining of the data change degree can include: detecting a number of bits of switched data in synchronization with the clock signal when the data is processed in synchronization with the clock signal by a unit of a plurality of bits; and determining the data change degree by using the number of bits of switched data.

The determining of the data change degree by using the number of bits of switched data can include: determining a section corresponding to the number of bits of switched data among a plurality of divided sections; and determining the data change degree corresponding to the determined section.

The output of the power voltage control signal can include outputting the power voltage control signal to increase the output power voltage value if the data change degree is increased.

The method can further include detecting a current generated by processing the data by using the power voltage, and the outputting of the power voltage control signal can include outputting the power voltage control signal by further considering the current value detected in the current detection unit.

The outputting of the power voltage control signal by further considering the current value detected in the current detection unit can include outputting the power voltage control signal increasing the voltage value output in the power voltage supplier if the current value detected in the current detection unit exceeds a predetermined current value.

The power supply device and the method for driving the power supply device according to the described technology have effects as follows.

Another aspect is a power supply device for a flat panel display, comprising a power voltage selector configured to select at least one of a plurality of predetermined voltage values according to a power voltage control signal and output the selected predetermined voltage value, a power voltage supplier configured to supply a power voltage corresponding to the selected predetermined voltage value to a display data processor, and a controller configured to i) generate the power voltage control signal based at least in part on a change in a number of switched data bits defined as a data change degree and ii) transmit the power voltage control signal to the power voltage selector, wherein the data bits are configured to be switched substantially synchronously with a clock signal.

The above power supply device further comprises a switching activity detector configured to detect the number of switched bits, wherein the controller is further configured to determine the data change degree.

In the above power supply device, the controller is further configured to determine a section corresponding to the number of switched data bits among a plurality of divided sections.

In the above power supply device, the controller is further configured to transmit the power voltage control signal when the number of switched data bits is greater than a previous number of switched data bits so as to increase the power voltage.

In the above power supply device, the power voltage selector includes a register configured to store the predetermined voltage values, and a multiplexor configured to select and output the predetermined voltage value according to the power voltage control signal.

The above power supply device further comprises a current detector configured to detect a current generated by processing the data based on the power voltage, wherein the controller is further configured to output the power voltage control signal based at least in part on the detected current.

In the above power supply device, if the detected current exceeds a predetermined current value, the controller is further configured to output the power voltage control signal so as to increase the voltage value output from the power voltage supplier.

Another aspect is a method of driving a power supply device for a display device, comprising first determining a data change degree of data processed substantially synchronously with a clock signal, first outputting a power voltage control signal according to the data change degree, selecting at least one of a plurality of predetermined voltage values according to the power voltage control signal, and second outputting a power voltage corresponding to the selected predetermined voltage value.

In the above power supply device, the first determining includes detecting a number of data bits of switched substantially synchronously with the clock signal while the data is processed, and second determining the data change degree based on the number of switched data bits.

In the above power supply device, the second determining includes determining a section corresponding to the number of switched data bits among a plurality of divided sections, and determining the data change degree corresponding to the determined section.

In the above power supply device, the second outputting includes outputting the power voltage control signal so as to increase the output power voltage value if the data change degree increases.

The above power supply device further comprises detecting a current generated by processing the data based on the power voltage, wherein the first outputting includes third outputting the power voltage control signal additionally based on the detected current.

The above power supply device the third outputting further includes outputting the power voltage control signal so as to increase the voltage value output in the power voltage supplier, if the detected current exceeds a predetermined current value.

Another aspect is a power supply device for a display device, comprising a power voltage supplier configured to supply power voltage corresponding to a predetermined voltage value to a display data processor, and a controller configured to i) generate a power voltage control signal based at least in part on a change in a number of switched data bits defined as a data change degree and ii) transmit the power voltage control signal to the power voltage selector so as to control the power voltage supplier, wherein the data bits are configured to be switched substantially synchronously with a clock signal.

The above power supply device further comprises a power voltage selector configured to select the predetermined voltage value according to the power voltage control signal and output the selected predetermined voltage value to the power voltage supplier.

The above power supply device further comprises a switching activity detector configured to detect the number of switched bits, wherein the controller is further configured to determine the data change degree.

In the above power supply device, the controller is further configured to determine a section corresponding to the number of switched data bits among a plurality of divided sections.

In the above power supply device, the controller is further configured to transmit the power voltage control signal when the number of switched data bits is greater than a previous number of switched data bits so as to increase the power voltage.

In the above power supply device, the power voltage selector includes a register configured to store the predetermined voltage values and a multiplexor configured to select and output the predetermined voltage value according to the power voltage control signal.

The above power supply device further comprises a current detector configured to detect a current generated by processing the data based on the power voltage, wherein the controller is further configured to output the power voltage control signal further based at least in part on the detected current, and wherein if the detected current exceeds a predetermined current value, the controller is further configured to output the power voltage control signal so as to increase the voltage value to be output from the power voltage supplier.

According to at least one embodiment, stable power voltage can be supplied.

According to at least one embodiment, the IC including the power supply device can efficiently compensate the voltage drop and can efficiently supply stable power.

DETAILED DESCRIPTION OF CERTAIN INVENTIVE EMBODIMENTS

Figure 1:
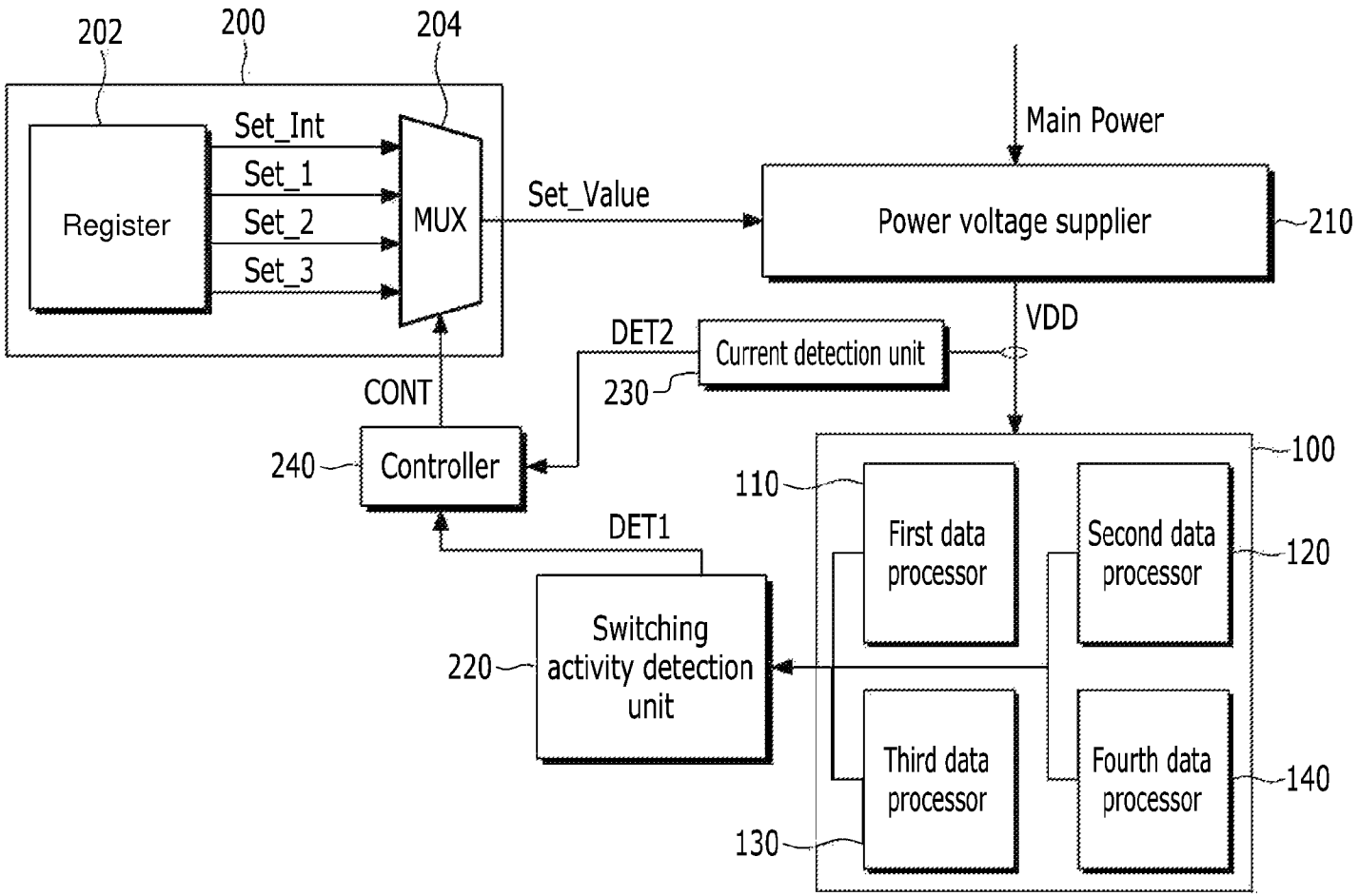
FIG. 1 is a block diagram of a power supply device according to an exemplary embodiment.

An increase in current consumption of a semiconductor device including a plurality of logic circuits can cause a power voltage drop in the device. When the power voltage is lower than the minimum threshold level of the logic circuits, the logic circuits can malfunction. Generally, as the width of the power supply line, formed of copper, electrically connected to the voltage regulator increases, resistance of the power supply line decreases and the consumption current decreases. However, as described above, when the width of the power supply line increases, it is difficult to further integrate more logic circuits into the semiconductor device. Also, generally, it is difficult for the voltage regulator to supply a substantially stable voltage due to switching activity in the logic circuits which is the largest factor in the amount of consumption current. Therefore, a separate analog voltage comparator to confirm the consumption current of the logic circuit must be provided.

Hereinafter, exemplary embodiments disclosed in the present specification will be described in detail with reference to the accompanying drawings. In the present specification, the same or similar components will be denoted by the same or similar reference numerals, and an overlapped description thereof will be omitted. The terms "module" and "unit" for components used in the following description are used only in order to easily make a specification. Therefore, these terms do not have meanings or roles that distinguish then from each other in themselves. Further, in describing exemplary embodiments of the present specification, when it is determined that a detailed description of the well-known art associated with the described technology can obscure the gist of the described technology, it will be omitted. In addition, the accompanying drawings are provided only in order to allow exemplary embodiments disclosed in the present specification to be easily understood and are not to be interpreted as limiting the spirit disclosed in the present specification, and it is to be understood that the described technology includes all modifications, equivalents, and substitutions without departing from the scope and spirit of the described technology.

Terms including ordinal numbers such as "first", "second", and the like will be used only to describe various components, and are not interpreted as limiting these components. The terms are only used to differentiate one component from other components.

It is to be understood that when one component is referred to as being "connected" or "coupled" to another component, it can be connected or coupled directly to another component or be connected or coupled to another component with the other component intervening therebetween. On the other hand, it is to be understood that when one component is referred to as being "connected or coupled directly" to another component, it can be connected to or coupled to another component without another component intervening therebetween.

Singular forms are to include plural forms unless the context clearly indicates otherwise.

It will be further understood that terms "comprise" or "have" used in the present specification specify the presence of stated features, numerals, steps, operations, components, parts, or a combination thereof, but do not preclude the presence or addition of one or more other features, numerals, steps, operations, components, parts, or a combination thereof. In this disclosure, the term "substantially" includes the meanings of completely, almost completely or to any significant degree under some applications and in accordance with those skilled in the art. Moreover, "formed on" can also mean "formed over." The term "connected" can include an electrical connection.

A power supply device according to an exemplary embodiment can be applied to various electronic devices such as a digital TV, a desktop computer, a cell phone, a smartphone, a laptop computer, a digital broadcasting terminal, a personal digital assistant (PDA), a portable multimedia player (PMP), a navigation device such as GPS, a slate PC, a tablet computer, an ultrabook, a wearable device such as a watch type terminal (a smartwatch), a glass terminal (a smart glass), and a head mounted display (HMD).

FIG. 1 is a block diagram of a power supply device according to an exemplary embodiment. The power supply device includes a power voltage selection unit or power voltage selector 200, a power voltage supplier 210, a switching activity detection unit or switching activity detector 220, a current detection unit or current detector 230, and a controller 240. The power supply device supplies a power voltage VDD to a data processor or a display data processor 100. The elements shown in FIG. 1 are not essential to realize the power supply device. Therefore, the power supply device described in the present specification can include more or fewer constituent elements than the described elements.

In detail, the power voltage selection unit 200 can output at least one among a plurality of predetermined voltage values according to a power voltage control signal CONT. The power voltage control signal CONT is output from the controller 240.

The power voltage selection unit 200 includes a register 202 and a mux or multiplexor 204. The register 204 can store a plurality of predetermined voltage values. For example, the register 202 stores a first predetermined voltage value Set_Int to a fourth predetermined voltage value Set_3 according to a size of the power voltage VDD supplied from the power voltage supplier 210.

Also, the mux 204 outputs at least one Set_Value among a plurality of predetermined voltage values Set_Int, Set_1, Set_2, and Set3 stored in the register 202.

If the operation of the electronic device including the power supply device starts, the mux 204 can output the first predetermined voltage value Set_Int to the power voltage supplier 210. Thus, the power voltage supplier 210 can supply the power voltage VDD corresponding to the first voltage predetermined value Set_Int to the data processor 100.

Next, the power voltage supplier 210 outputs the power voltage VDD corresponding to the predetermined voltage value. Also, the power voltage VDD is supplied to the data processor 100.

The power voltage supplier 210 receives an input voltage (main power) that is not necessarily stable, and supplies the power voltage VDD that is substantially stabilized. For example, the input voltage (main power) is provided from an external power generator or a battery.

Next, the switching activity detection unit 220 can detect the number of data bits that are switched synchronously with a clock signal when data is processed by the data processor 100. The switching activity detection unit 220 is connected to the data processor 100 via a data bus.

Also, the switching activity detection unit 220 can transmit the number of the switched data bits DET1 to the controller 240. The operation of the switching activity detection unit 220 will be described with reference to FIG. 3 and FIG. 4.

The current detection unit 230 can detect the current flowing through a voltage supply line supplying the power voltage VDD. The current detection unit 230 can further include at least one sensor to detect the current flowing through the voltage supply line.

Also, the current detection unit 230 can output the current data value DET2, which represents the current flowing through the voltage supply line, to the controller 240.

The controller 240 can transmit the power voltage control signal CONT to the mux 204 in the power voltage selection unit 200. The power voltage control signal CONT represents a degree of change of the switched data. In this case, the controller 240 can determine the data change degree by using the number of bits of the data DET1. The data change degree can represent a change in the number of switched bits between the current clock cycle and a previous clock cycle.

Also, the controller 240 determines a section corresponding to the number of the switched data bits among a plurality of divided sections.

For example, when the data processor 100 processes the data by 8 bit units and the clock signal is enabled, the sections can be divided into a first section if the number of bits of the switched data is 6 to 8, a second section if the number of bits of the switched data is 4 or 5, and a third section if the number of bits of the switched data is 0 to 3.

In this example, controller 240 can determine the corresponding section among the first section to the third section by using the switched number of bits of the data DET1 output from the switching activity detection unit 220.

Also, the controller 240 can determine the data change degree by using the determined section. For example, the controller 240 determines the first section in which the data change degree is a high level, the second section in which the data change degree is a normal level, and the third section in which the data change degree is a low level.

The controller 240 can output the power voltage control signal CONT corresponding to the determined data change degree. For example, the controller 240 outputs the power voltage control signal CONT increasing the voltage value output from the power voltage supplier 210 if the data change degree is increased.

Also, the controller 240 can output the power voltage control signal CONT by further considering the current value detected from the current detection unit 230. For example, the controller 240 outputs the power voltage control signal CONT increasing the power voltage value output from the power voltage supplier 210 if the output data value DET2 is over a predetermined current value.

The controller 240 processes the signal, the data, and the information input or output through the described elements, thereby substantially stably supplying the power voltage VDD to the data processor 100.

The IC can further include the data processor 100 and a memory device (not shown) that are supplied with the substantially stable power through the power supply device, and can further include a plurality of logic circuits (not shown) performing various functions. The IC can be realized with a system-on-chip (SoC) type in which the power supply device and the data processor 100 is formed as one chip.

The data processor 100 can include a plurality of data processors 110, 120, 130, and 140, and can perform specific calculations or tasks. In some embodiments, the data processor 100 is a microprocessor or a central processing unit (CPU).

The data processor 100 can be connected to the memory device (not shown), the storing device (not shown), and the input and output device (not shown) through an address bus, a control bus, and a data bus to communicate. According to an exemplary embodiment, the data processor 100 can also be connected to an expansion bus such as peripheral component interconnect (PCI) bus.

On the other hand, the data processor 100 can be realized with a form of a single core or a multi-core. For example, an ARM core processor can be realized with the single core when being operated by using a system clock at less than about 1 GHz, and can be realized with the multi-core in the case of a next generation processor operated at a high speed by using a system clock at more than about 1 GHz. Also, the next generation ARM core processor can perform the communication with the peripheral device through an AXI (advanced extensible interface) bus.

Hereafter, embodiments related to the driving method realized in the above configured power supply device will be described with reference to accompanying drawings. It is obvious to those skilled in the art that the described technology can be modified in various different ways without departing from the spirit or essential features.

Next, a driving method of the voltage supply device will be described with reference to FIG. 2.

Figure 2:
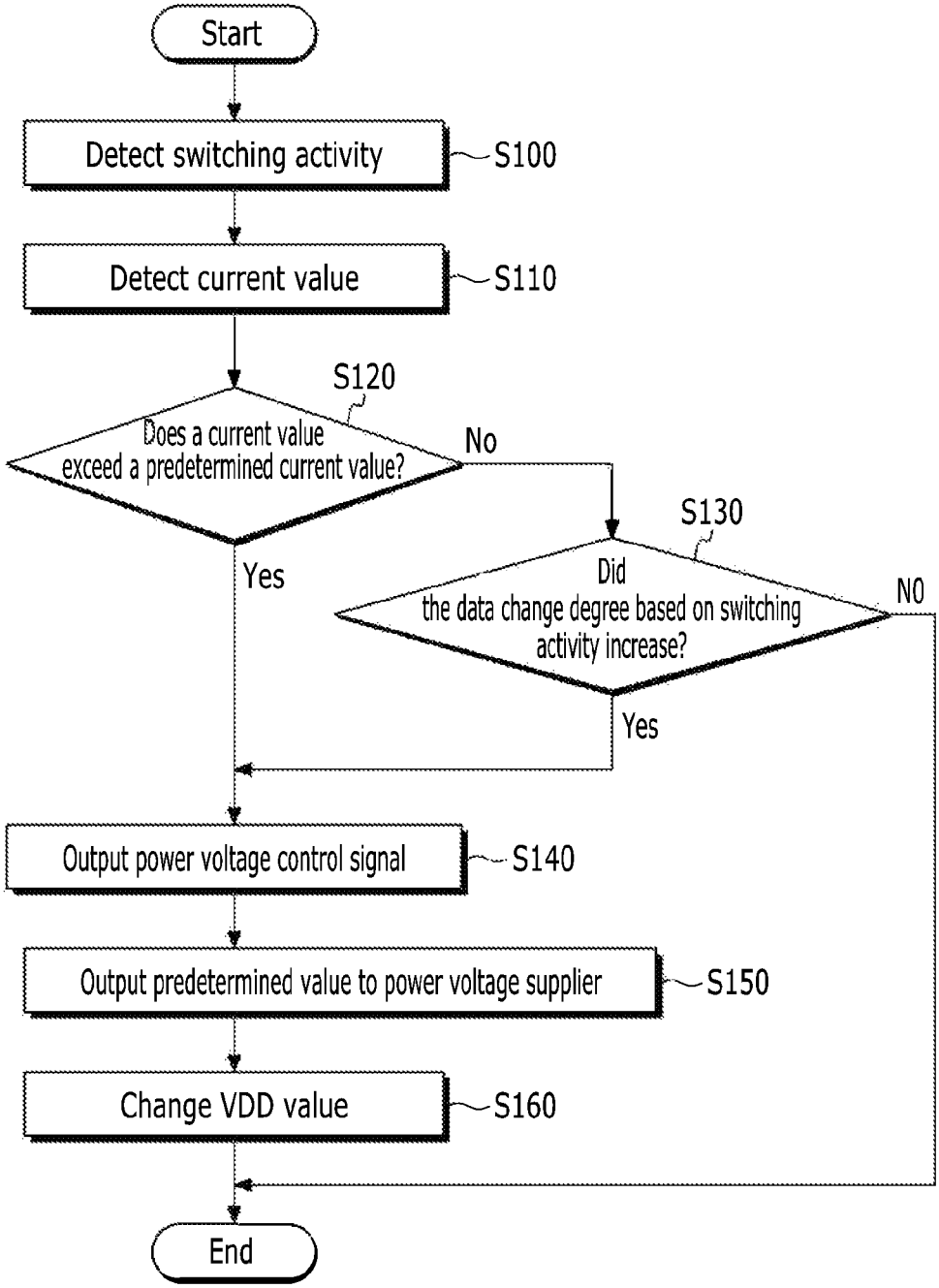
FIG. 2 is a flowchart of a method for driving a power supply device according to an exemplary embodiment.

FIG. 2 is a flowchart of a method for driving a power supply device according to an exemplary embodiment.

In some embodiments, the FIG. 2 procedure is implemented in a conventional programming language, such as C or C++ or another suitable programming language. The program can be stored on a computer accessible storage medium of the data processor 100, for example, a memory (not shown) of the data processor 100. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 2.

First, the switching activity detection unit 220 detects the number of switched data bits in the data processor 100 (S100).

The current detection unit 230 detects the current flowing to the data processor 100 (S110). For example, the current detection unit 230 measures the current flowing through the power voltage supply line connecting the power voltage supplier 210 to the data processor 100.

Next, the controller 240 determines whether the detected current value is over a predetermined current value (S120).

Also, the controller 240 determines the data change degree based on the switching activity data when the detected current value is over the predetermined current value (S130).

The controller 240 can determine the section corresponding to the number of switched data bits based on the switching activity data among the divided sections. Thus, the controller 240 can determine the data change degree corresponding to the determined section.

On the other hand, the controller 240 does not output the power voltage control signal CONT when it is determined that the value of the power voltage VDD to be applied to the data processor 100 is substantially the same as the value of the power voltage VDD being applied to the data processor 100. That is, in this case, the controller 240 does not output the power voltage control signal CONT.

However, if it is determined that the detection current value is over the predetermined current value and the value of the power voltage VDD is different from the value of the power voltage VDD to be changed, the power voltage control signal CONT is output.

Next, the controller 240 outputs the power voltage control signal CONT according to the current value or the determined data change degree (S140).

For example, the controller 240 transmits the power voltage control signal CONT to supply the power voltage VDD to the data processor 100 if the detected current value exceeds the predetermined current value.

In another example, the controller 240 also outputs the power voltage control signal CONT corresponding to the determined data change degree when the detected current value is less than the predetermined current. The controller 240 outputs the power voltage control signal CONT corresponding to the data change degree of the high level to transmit the fourth predetermined voltage value Set_3 to the power voltage supplier 210. Further, the controller 240 outputs the power voltage control signal CONT corresponding to the data change degree of the normal level to transmit the third predetermined voltage value Set_2 to the power voltage supplier 210. Also, the controller 240 outputs the power voltage control signal CONT corresponding to the data change degree of the low level to output the second predetermined voltage value Set_1 to the power voltage supplier 210.

Next, the power voltage selection unit 200 outputs the predetermined voltage value to the power voltage supplier 210 according to the transmitted power voltage control signal CONT (S150). The mux 204 outputs at least one corresponding predetermined voltage value Set_Value to the power voltage supplier 210 among the predetermined voltage values output by the register 202 according to the power voltage control signal CONT received from the controller 240.

The power voltage supplier 210 changes and supplies the value of the power voltage VDD supplied to the data processor 100 according to the transmitted predetermined voltage value Set_Value (S160).

When the operation current transmitted to the data processor 100 or the switching activity to process the data is increased, the power voltage VDD supplied to the data processor 100 can be reduced.

In some embodiments, if the current transmitted to the data processor 100 is increased, the power voltage VDD applied to the data processor 100 from the power voltage supplier 210 is increased so as to compensate the decreased power voltage VDD. Likewise, if the switching activity of the data processor 100 is increased, the power voltage VDD applied from the power voltage supplier 210 to the data processor 100 is increased so as to compensate the decreased power voltage VDD.

Accordingly, the power voltage VDD is substantially uniformly supplied to the data processor 100, thereby substantially stably operating the data processor 100.

Next, the operation of the switching activity detection unit 220 will be described with reference to FIG. 3 and FIG. 4.

Figure 3:
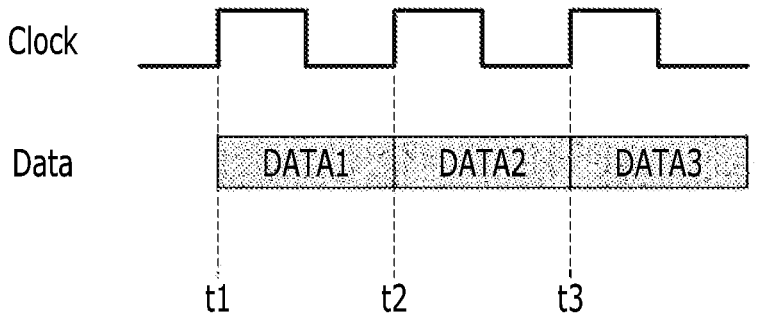
FIG. 3 and FIG. 4 are diagrams illustrating detecting switching activity and determining a data change degree for a power supply device according to an exemplary embodiment.
Figure 4:
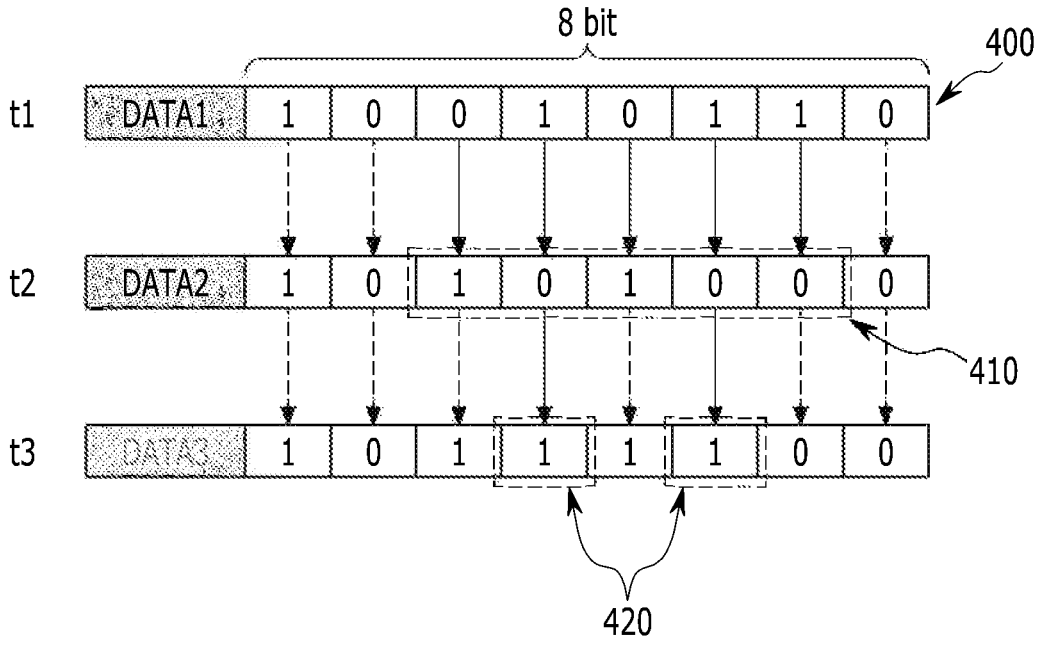

FIG. 3 and FIG. 4 are diagrams for explaining detecting switching activity and determining data change degree for a power supply device according to an exemplary embodiment.

As shown in FIG. 3, according to the clock signal Clock that is periodically set to enable, the data is processed in the data processor 100 or transmitted to the data processor 100 through the data bus. At this time, the data is processed in multiple bits.

For example, in the data processor 100, the first data DATA1 is processed according to the clock signal that is set to enable at time t1, the second data DATA2 is processed according to the clock signal that is set to enable at time t2, and the third data DATA3 is processed according to the clock signal that is set to enable at time t3.

As shown in FIG. 4, the processed first data to third data DATA1 to DATA3 are 8 bits, and after the first data DATA1 is processed in the data processor 100 at time t1, the second data DATA2 is processed in the data processor 100 at time t2.

Also, after the second data DATA2 is processed in the data processor 100 at time t2, the third data DATA3 is processed in the data processor 100 at time t3.

In this case, the data can be switched in each bit from the low level to the high level or from the high level to the low level. For example, the number of switched bits is a total of 5 bits at time t2, and the number of switched bits is a total of 2 bits at time t3.

Thus, the number of switched bits 410 and 420 is detected by the switching activity detection unit 220, and the switching activity detection unit 220 transmits the number of switched bits of data DET1 to the controller 240.

Next, referring to FIG. 5, the current detected in the current detection unit 230 according to an exemplary embodiment and the power voltage VDD of the data processor 100 will be described.

Figure 5:
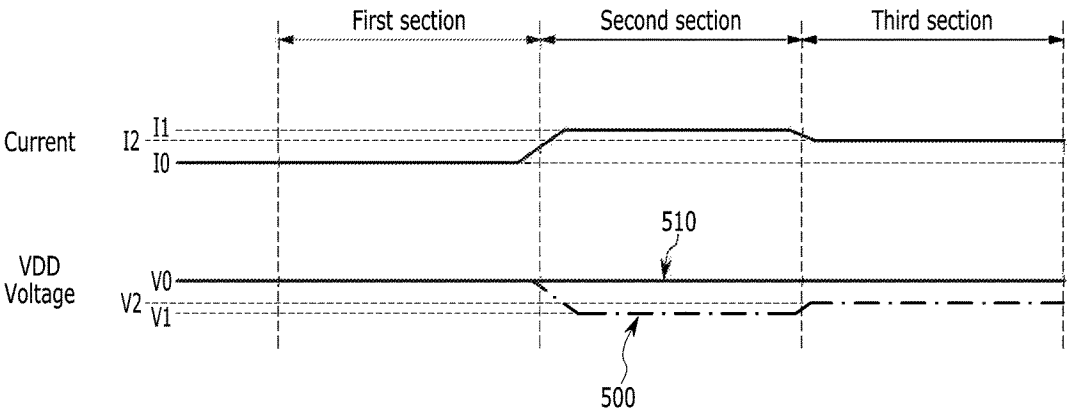
FIG. 5 is a diagram of power voltage output according to a detection current from a power supply device according to an exemplary embodiment.

FIG. 5 is a diagram of a power voltage VDD output according to a detection current from a power supply device according to an exemplary embodiment. As described above, the initial power voltage VDD of V0 can be supplied to the data processor 100 in the first section. At this time, the current detected in the current detection unit 230 can be I0.

In the second section, because the data processing is increased in the data processor 100, the current increases to I1 rather than I0 detected by the current detection unit 230. In this case, when the power voltage VDD drops in the power voltage supplier 210 (500), the voltage applied to the data processor 100 is decreased to V1.

However, in some embodiments, the value of the power voltage VDD supplied from the power voltage supplier 210 to the data processor 100 is increased corresponding to the detection current I1.

As a result, in the second section, like the first section, the power voltage VDD of V0 is supplied to the data processor 100.

Next, when the value of the current detected in the third section is decreased to I2, if the power voltage VDD drops in the power voltage supplier 210, the voltage supplied to the data processor 100 can be changed to V2 which is less than V0 (500).

However, in some embodiments, the value of the power voltage VDD supplied from the power voltage supplier 210 to the data processor 100 is decreased corresponding to the detection current I2.

Thus, in the third section, like the first section and the second section, the power voltage VDD of V0 is supplied to the data processor 100.

At least some of the respective components described above can be cooperatively operated in order to implement the operation, the control, or the driving method of the power supply device and the IC including the power supply device according to various exemplary embodiments to be described below.

The described technology can be implemented by a computer readable medium in which a program is recorded. The computer readable medium can include all kinds of recording apparatuses in which data that can be read by a computer system are stored. An example of the computer readable medium can include a hard disk drive (HDD), a solid state disk (SSD), a silicon disk drive (SDD), a read only memory (ROM), a random access memory (RAM), a compact disk read only memory (CD-ROM), a magnetic tape, a floppy disk, an optical data storage, or the like, and can also include a medium implemented in a form of a carrier wave (for example, transmission through the Internet). In addition, the computer can also include the control unit 160 of the battery testing apparatus.

It should be understood that the exemplary embodiments described herein should be considered in a descriptive sense only and not for purposes of limitation. Descriptions of features or aspects within each embodiment should typically be considered as available for other similar features or aspects in other embodiments. While the inventive technology has been described with reference to the figures, it will be understood by those of ordinary skill in the art that various changes in form and details can be made therein without departing from the spirit and scope of the present invention as defined by the following claims.

What is claimed is:

1. A power supply device for a display device, comprising:

a power voltage selector configured to select at least one of a plurality of predetermined voltage values according to a power voltage control signal and output the selected predetermined voltage value;

a power voltage supplier configured to supply a power voltage corresponding to the selected predetermined voltage value to a display data processor; and a controller configured to i) generate the power voltage control signal based at least in part on a change in a number of switched data bits defined as a data change degree and ii) transmit the power voltage control signal to the power voltage selector, wherein the data bits are configured to be switched substantially synchronously with a clock signal, wherein the controller is further configured to transmit the power voltage control signal when the number of switched data bits is greater than a previous number of switched data bits so as to increase the power voltage.

2. The power supply device of claim 1, further comprising:

a switching activity detector configured to detect the number of switched bits, wherein the controller is further configured to determine the data change degree.

3. The power supply device of claim 2, wherein the controller is further configured to determine a section corresponding to the number of switched data bits among a plurality of divided sections.

4. The power supply device of claim 1, wherein the power voltage selector includes:

a register configured to store the predetermined voltage values; and a multiplexor configured to select and output the predetermined voltage value according to the power voltage control signal.

5. The power supply device of claim 1, further comprising a current detector configured to detect a current generated by processing the data based on the power voltage, wherein the controller is further configured to output the power voltage control signal based at least in part on the detected current.

6. The power supply device of claim 5, wherein, if the detected current exceeds a predetermined current value, the controller is further configured to output the power voltage control signal so as to increase the voltage value output from the power voltage supplier.

7. A method of driving a power supply device for a display device, comprising:

determining a data change degree of data processed substantially synchronously with a clock signal;

outputting a power voltage control signal according to the data change degree;

selecting at least one of a plurality of predetermined voltage values according to the power voltage control signal; and outputting a power voltage corresponding to the selected predetermined voltage value, wherein the determining the data change degree of data processed substantially synchronously with the clock signal includes:

detecting a number of data bits switched between a data and a preceding data substantially synchronously with the clock signal while the data is processed; and determining the data change degree based on the number of switched data bits.

8. The method of claim 7, wherein the determining the data change degree based on the number of switched data bits includes:

determining a section corresponding to the number of switched data bits among a plurality of divided sections; and determining the data change degree corresponding to the determined section.

9. The method of claim 7, wherein the outputting the power voltage corresponding to the selected predetermined voltage value includes outputting the power voltage control signal so as to increase the output power voltage value if the data change degree increases.

10. The method of claim 7, further comprising detecting a current generated by processing the data based on the power voltage, wherein the outputting the power voltage control signal according to the data change degree includes outputting the power voltage control signal additionally based on the detected current.

11. The method of claim 10, wherein the outputting the power voltage control signal additionally based on the detected current further includes outputting the power voltage control signal so as to increase the voltage value output in the power voltage supplier, if the detected current exceeds a predetermined current value.

12. A power supply device for a display device, comprising:

a power voltage supplier configured to supply power voltage corresponding to a predetermined voltage value to a display data processor; and a controller configured to i) generate a power voltage control signal based at least in part on a change in a number of switched data bits defined as a data change degree and ii) transmit the power voltage control signal to a power voltage selector so as to control the power voltage supplier, wherein the data bits are configured to be switched substantially synchronously with a clock signal, wherein the power voltage selector is configured to select the predetermined voltage value according to the power voltage control signal and output the selected predetermined voltage value to the power voltage supplier; and a switching activity detector configured to detect the number of switched bits, wherein the controller is further configured to determine the data change degree, and wherein the controller is further configured to transmit the power voltage control signal when the number of switched data bits is greater than a previous number of switched data bits so as to increase the power voltage.

13. The power supply device of claim 12, wherein the controller is further configured to determine a section corresponding to the number of switched data bits among a plurality of divided sections.

14. The power supply device of claim 12, wherein the power voltage selector includes:

a register configured to store the predetermined voltage values; and a multiplexor configured to select and output the predetermined voltage value according to the power voltage control signal.

15. The power supply device of claim 12, further comprising a current detector configured to detect a current generated by processing the data based on the power voltage, wherein the controller is further configured to output the power voltage control signal further based at least in part on the detected current, and wherein if the detected current exceeds a predetermined current value, the controller is further configured to output the power voltage control signal so as to increase the voltage value to be output from the power voltage supplier.

16. A power supply device for a display device, comprising:

a power voltage supplier configured to supply power voltage corresponding to a predetermined voltage value to a display data processor; and a controller configured to i) generate a power voltage control signal based at least in part on a change in a number of switched data bits defined as a data change degree and ii) transmit the power voltage control signal to the power voltage selector so as to control the power voltage supplier, wherein the data bits are configured to be switched substantially synchronously with a clock signal, wherein the controller is further configured to transmit the power voltage control signal when the number of switched data bits is greater than a previous number of switched data bits so as to increase the power voltage.

17. The power supply device of claim 16, further comprising:

a switching activity detector configured to detect the number of switched bits, wherein the controller is further configured to determine the data change degree.

18. The power supply device of claim 17, wherein the controller is further configured to determine a section corresponding to the number of switched data bits among a plurality of divided sections.

19. The power supply device of claim 16, wherein the power voltage selector includes:

a register configured to store the predetermined voltage values; and a multiplexor configured to select and output the predetermined voltage value according to the power voltage control signal.

20. The power supply device of claim 16, further comprising a current detector configured to detect a current generated by processing the data based on the power voltage, wherein the controller is further configured to output the power voltage control signal further based at least in part on the detected current, and wherein if the detected current exceeds a predetermined current value, the controller is further configured to output the power voltage control signal so as to increase the voltage value to be output from the power voltage supplier.

* * * * *